US010810965B2

(12) United States Patent
Seong et al.

(10) Patent No.: US 10,810,965 B2
(45) Date of Patent: Oct. 20, 2020

(54) GATE DRIVING CIRCUIT AND DISPLAY APPARATUS INCLUDING THE SAME

(71) Applicant: Samsung Display Co., Ltd., Yongin-Si, Gyeonggi-Do (KR)

(72) Inventors: Jaemin Seong, Suwon-si (KR); Youngjae Jeon, Asan-si (KR); Mincheol Chae, Asan-si (KR); Jaeho Choi, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 109 days.

(21) Appl. No.: 15/798,925

(22) Filed: Oct. 31, 2017

(65) Prior Publication Data

US 2018/0182345 A1 Jun. 28, 2018

(30) Foreign Application Priority Data

Dec. 22, 2016 (KR) ..... 10-2016-0176964

(51) Int. Cl.
*G09G 3/36* (2006.01)

(52) U.S. Cl.
CPC ..... *G09G 3/3688* (2013.01); *G09G 3/3614* (2013.01); *G09G 3/3648* (2013.01); *G09G 3/3677* (2013.01); *G09G 2300/0823* (2013.01); *G09G 2310/0286* (2013.01); *G09G 2310/0289* (2013.01); *G09G 2310/061* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

2007/0001991 A1* 1/2007 Jang ..... G09G 3/3677 345/100
2008/0278467 A1* 11/2008 Hwang ..... G09G 3/3648 345/205
2010/0201668 A1* 8/2010 Ko ..... G09G 3/3677 345/211
2012/0162187 A1* 6/2012 Lee ..... G09G 3/007 345/212
2015/0077407 A1* 3/2015 Kim ..... G09G 3/3611 345/204
2016/0247479 A1* 8/2016 Cho ..... G09G 3/3677

FOREIGN PATENT DOCUMENTS

KR 1020160087950 A 7/2016
KR 1020160089028 A 7/2016
KR 1020160094462 A 8/2016
KR 1020160096777 A 8/2016
KR 1020160117709 A 10/2016

* cited by examiner

*Primary Examiner* — Stephen T. Reed
(74) *Attorney, Agent, or Firm* — Cantor Colburn LLP

(57) ABSTRACT

A gate driving circuit includes a pull-up control part applying a previous carry signal of one of previous stages to a first node in response to the previous carry signal, a pull-up part outputting a clock signal as an N-th gate output signal in response to a signal at the first node, a carry part outputting the clock signal as an N-th carry signal in response to the signal at the first node, a first pull-down part pulling down the signal at the first node to a second off voltage in response to a first next carry signal of one of next stages and a second pull-down part pulling down the N-th gate output signal to a first off voltage in response to a second next carry signal of one of the next stages different from the first next carry signal.

19 Claims, 9 Drawing Sheets

GATE DRIVING CIRCUIT AND DISPLAY APPARATUS INCLUDING THE SAME

This application claims priority to Korean Patent Application No. 10-2016-0176964, filed on Dec. 22, 2016, and all the benefits accruing therefrom under 35 U. S. C. § 119, the content of which in its entirety is herein incorporated by reference.

BACKGROUND

1. Field

Exemplary embodiments of the invention relate to a gate driving circuit and a display apparatus including the gate driving circuit. More particularly, exemplary embodiments of the invention relate to a gate driving circuit improving a reliability and a display apparatus including the gate driving circuit.

2. Description of the Related Art

Generally, a liquid crystal display ("LCD") apparatus includes a first substrate including a pixel electrode, a second substrate including a common electrode and a liquid crystal layer disposed between the first and second substrate. An electric field is generated by voltages respectively applied to the pixel electrode and the common electrode. By adjusting an intensity of the electric field, a transmittance of a light passing through the liquid crystal layer may be adjusted so that a desired image may be displayed.

Generally, a display apparatus includes a display panel and a display panel driver. The display panel includes a plurality of gate lines and a plurality of data lines. The display panel driver includes a gate driver providing gate signals to the plurality of gate lines and a data driver providing data voltages to the plurality of data lines.

SUMMARY

A gate driver includes a gate driving circuit including a plurality of switching element. The plurality of switching elements may be a thin film transistors ("TFT"). In a conventional gate driving circuit, the TFT having a relatively great drain-source voltage may be deteriorated as using time increases. Due to the deteriorated TFTs, the gate driving circuit may not be operated normally. Due to the abnormal operation of the TFTs, redundant gate signals may be outputted from the gate driver so that a line defect may be generated in a display panel.

Exemplary embodiments of the invention provide a gate driving circuit improving a display quality of a display panel and improving a reliability of the gate driving circuit.

Exemplary embodiments of the invention also provide a display apparatus including the gate driving circuit.

In an exemplary embodiment of a gate driving circuit according to the invention, the gate driving circuit includes a pull-up control part, a pull-up part, a carry part, a first pull-down part and a second pull-down part. The pull-up control part applies a previous carry signal of one of previous stages to a first node in response to the previous carry signal. The pull-up part outputs a clock signal as an N-th gate output signal in response to a signal at the first node. The carry part outputs the clock signal as an N-th carry signal in response to the signal at the first node. The first pull-down part pulls down the signal at the first node to a second off voltage in response to a first next carry signal of one of next stages. The second pull-down part pulls down the N-th gate output signal to a first off voltage in response to a second next carry signal of one of the next stages different from the first next carry signal. N is a positive integer.

In an exemplary embodiment, the first next carry signal may have a timing later than a timing of the second next carry signal.

In an exemplary embodiment, the gate driving circuit may further comprise a first next stage disposed at a first next stage position from a present stage, a second next stage disposed at a second next stage position from the present stage, and a third next stage position disposed at a third next stage position from the present stage. The first next carry signal may be a carry signal of the third next stage. The second next carry signal may be a carry signal of the second next stage.

In an exemplary embodiment, a first clock signal may be applied to the present stage. A second clock signal different from the first clock signal may be applied to the first next stage. A third clock signal different from the first clock signal and the second clock signal may be applied to the second next stage. A fourth clock signal different from the first clock signal, the second clock signal and the third clock signal may be applied to the third next stage.

In an exemplary embodiment, the third clock signal may be an inverted signal of the first clock signal. The fourth clock signal may be an inverted signal of the second clock signal.

In an exemplary embodiment, the gate driving circuit may further include a carry pull down part which pulls down the N-th carry signal to the second off voltage in response to the second next carry signal.

In an exemplary embodiment, the gate driving circuit may further include an inverting part which generates an inverting signal based on the clock signal and the second off voltage and output the inverting signal to an inverting node.

In an exemplary embodiment, the inverting part may include a first inverting transistor, a second inverting transistor, a third inverting transistor, and a fourth inverting transistor. The first inverting transistor and the third inverting transistor may be connected to each other in series and the second inverting transistor and the fourth inverting transistor may be connected to each other in series. The first inverting transistor may include a control electrode and an input electrode to which the clock signal is commonly applied and an output electrode connected to a third node. The second inverting transistor may include a control electrode connected to the third node, an input electrode to which the clock signal is applied and an output electrode connected to the inverting node. The third inverting transistor may include a control electrode connected to a carry terminal from which the N-th carry signal is outputted, an input electrode to which the second off voltage is applied and an output electrode connected to the third node. The fourth inverting transistor may include a control electrode connected to the carry terminal, an input electrode to which the second off voltage is applied and the output electrode connected to the inverting node.

In an exemplary embodiment, the gate driving circuit may further include a first holding part which pulls down the signal at the first node to the second off voltage in response to the inverting signal at the inverting node.

In an exemplary embodiment, the gate driving circuit may further include a second holding part which pulls down the N-th gate output signal to the first off voltage in response to the inverting signal at the inverting node.

In an exemplary embodiment, the gate driving circuit may further include a third holding part which pulls down the N-th carry signal to the second off voltage in response to the inverting signal at the inverting node.

In an exemplary embodiment, the gate driving circuit may further include a fourth holding part which pulls down the signal at the first node to the second off voltage in response to a third next carry signal of one of the next stages different from the first next carry signal and the second next carry signal.

In an exemplary embodiment, the gate driving circuit may further include a first reset part which pulls down the N-th gate output signal to the first off voltage in response to a reset signal, a second reset part which pulls down the signal at the first node to the second off voltage in response to the reset signal and a third reset part which pulls down the N-th carry signal to the second off voltage in response to the reset signal.

In an exemplary embodiment, the gate driving circuit may further include a carry pull down part which pulls down the N-th carry signal to the second off voltage in response to an inverted clock signal different from the clock signal.

In an exemplary embodiment, the gate driving circuit may further include a fourth holding part which pulls down the signal at the first node to the second off voltage in response to a third next carry signal of one of the next stages different from the first next carry signal and the second next carry signal.

In an exemplary embodiment, the gate driving circuit may further include a first holding part which applies the N-th carry signal to the first node in response to the clock signal.

In an exemplary embodiment, the gate driving circuit may further include a second holding part which pulls down the N-th gate output part to the first off voltage in response to the inverted clock signal.

In an exemplary embodiment of a display apparatus according to the invention, the display apparatus includes a display panel, a data driving circuit and a gate driving circuit. The display panel displays an image. The data driving circuit applies a data voltage to the display panel. The gate driving circuit applies a gate output signal to the display panel. The gate driving circuit includes a pull-up control part which applies a previous carry signal of one of previous stages to a first node in response to the previous carry signal, a pull-up part which outputs a clock signal as an N-th gate output signal in response to a signal at the first node, a carry part which outputs the clock signal as an N-th carry signal in response to the signal at the first node, a first pull-down part which pulls down the signal at the first node to a second off voltage in response to a first next carry signal of one of next stages and a second pull-down part which pulls down the N-th gate output signal to a first off voltage in response to a second next carry signal of one of the next stages different from the first next carry signal. N is a positive integer.

In an exemplary embodiment, the first next carry signal may have a timing later than a timing of the second next carry signal.

In an exemplary embodiment, the display apparatus may further comprise a first next stage disposed at a first next stage position from a present stage, a second next stage disposed at a second next stage position from the present stage, and a third next stage position disposed at a third next stage position from the present stage. The first next carry signal may be a carry signal of the third next stage. The second next carry signal may be a carry signal of the second next stage.

According to the gate driving circuit and the display apparatus including the gate driving circuit, a carry signal having a timing different from a timing of a carry signal applied to a second pull down part and a carry pull down part is applied to a first pull down part so that pulling down of drain-source voltage may be decreased. Thus, the abnormal operation of the thin film transistor of the first pull down part may be prevented so that the reliability of the gate driving circuit may be improved. In addition, the abnormal operation of the thin film transistor may be prevented so that the display quality of the display panel may be improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
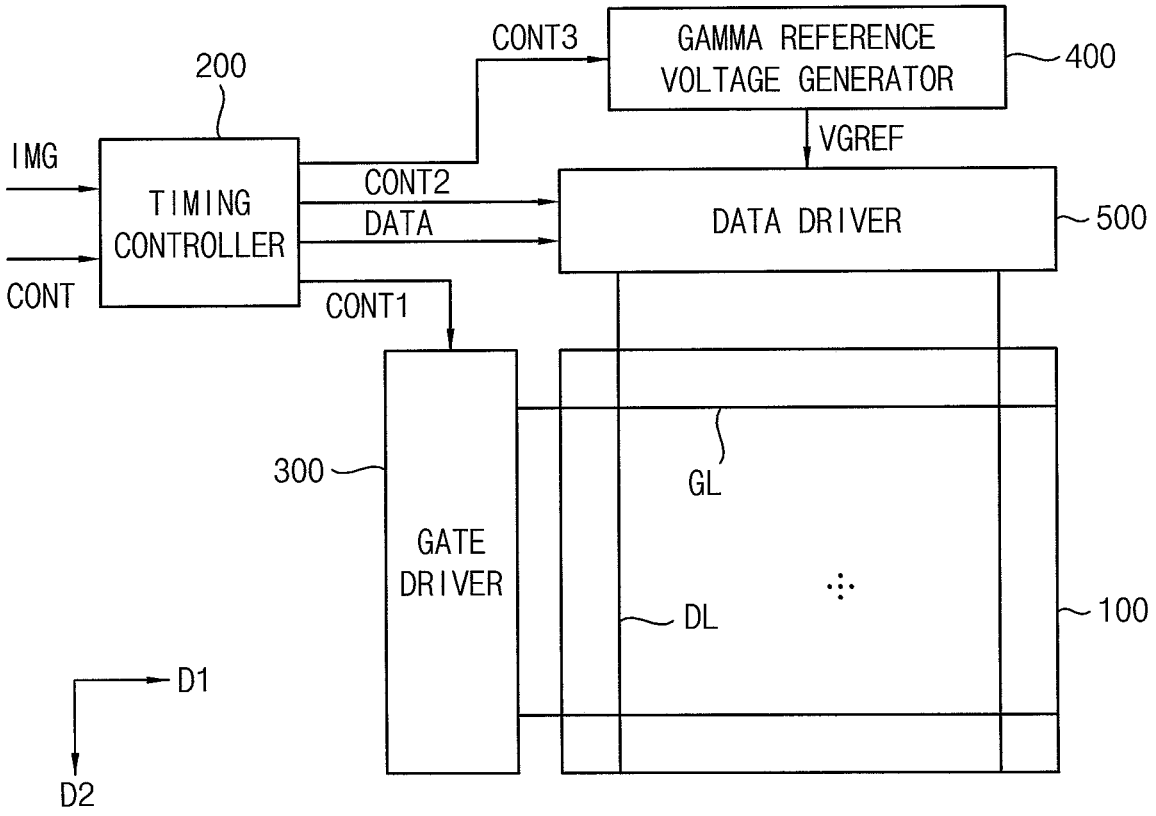
FIG. 1 is a block diagram illustrating an exemplary embodiment of a display apparatus according to the invention.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. Further, the ordinal number in the detailed description may not be the same as that of the claims due to an introduction order of elements in the claims.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to an exemplary embodiment of the invention.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GL, a plurality of data lines DL and a plurality of unit pixels connected to the gate lines GL and the data lines DL. The gate lines GL extend in a first direction D1 and the data lines DL extend in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed in a matrix form.

The timing controller 200 receives input image data IMG and an input control signal CONT from an external apparatus (not shown). In an exemplary embodiment, the input image data may include red image data, green image data and blue image data. However, the invention is not limited thereto, and the input image data may include various other color image data. In an exemplary embodiment, the input control signal CONT may include a master clock signal and a data enable signal, for example. In an exemplary embodiment, the input control signal CONT may include a vertical synchronizing signal and a horizontal synchronizing signal, for example.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. In an exemplary embodiment, the first control signal CONT1 may further include a vertical start signal and a gate clock signal, for example.

The timing controller 200 generates the second control signal CONT2 for controlling an operation of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DATA based on the input image data IMG The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly disposed (e.g., mounted) on the display panel 100, or may be connected to the display panel 100 as a tape carrier package ("TCP") type, for example. In an alternative exemplary embodiment, the gate driver 300 may be integrated on the display panel 100.

A structure of the gate driver 300 is described referring to FIGS. 2 to 6 in detail.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In another exemplary embodiment, the gamma reference voltage generator 400 may be disposed in the timing controller 200, or in the data driver 500, for example.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be directly disposed (e.g., mounted) on the display panel 100, or be connected to the display panel 100 in a TCP type, for example. In an alternative exemplary embodiment, the data driver 500 may be integrated on the display panel 100.

Figure 2:
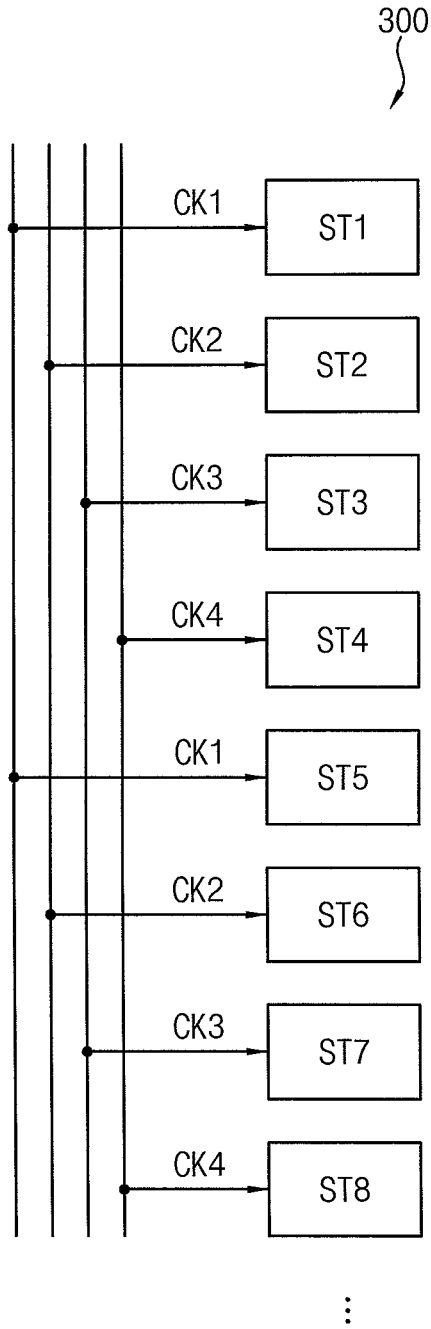
FIG. 2 is a block diagram illustrating stages of a gate driver of FIG. 1.
Figure 3:
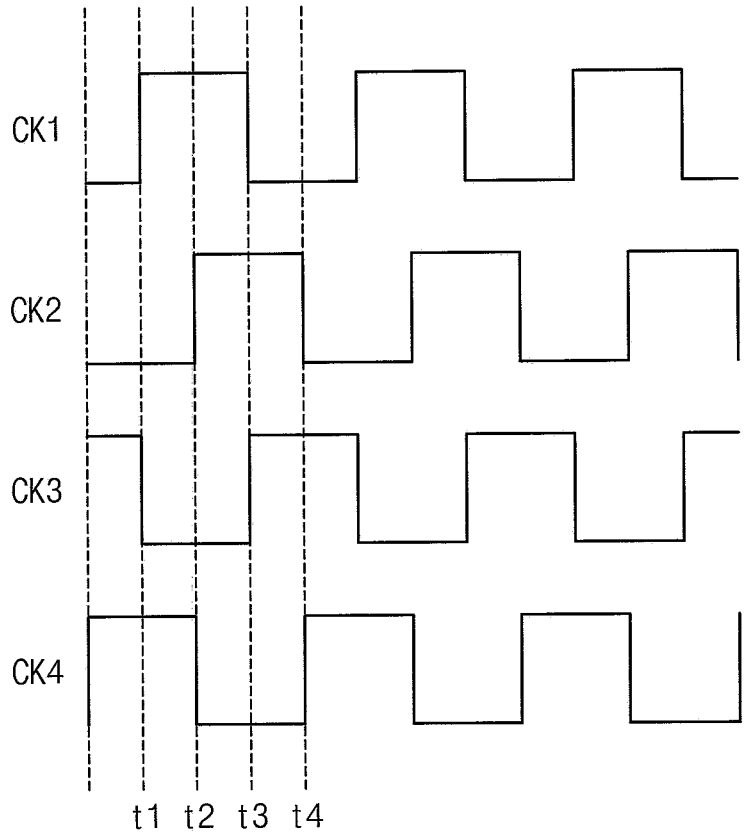
FIG. 3 is a waveform diagram illustrating clock signals applied to the stages of FIG. 2.

FIG. 2 is a block diagram illustrating stages of the gate driver 300 of FIG. 1. FIG. 3 is a waveform diagram illustrating clock signals applied to the stages of FIG. 2.

Referring to FIGS. 1 to 3, the gate driver 300 includes a plurality of stages. In an exemplary embodiment, clock signals (e.g. CK1, CK2, CK3 and CK4) having four different timings may be applied to the stages of the gate driver 300, for example.

In an exemplary embodiment, a first clock signal CK1 may be applied to a first stage ST1, for example. A second clock signal CK2 different from the first clock signal CK1 may be applied to a second stage ST2 adjacent to the first stage ST1. A third clock signal CK3 different from the first clock signal CK1 and the second clock signal CK2 may be applied to a third stage ST3 adjacent to the second stage ST2. A fourth clock signal CK4 different from the first clock signal CK1, the second clock signal CK2 and the third clock signal CK3 may be applied to a fourth stage ST4 adjacent to the third stage ST3.

The first clock signal CK1 may be applied to a fifth stage ST5 adjacent to the fourth stage ST4. The second clock signal CK2 may be applied to a sixth stage ST6 adjacent to the fifth stage ST5. The third clock signal CK3 may be applied to a seventh stage ST7 adjacent to the sixth stage ST6. The fourth clock signal CK4 may be applied to an eighth stage ST8 adjacent to seventh stage ST7.

The first to fourth clock signals CK1, CK2, CK3 and CK4 may be applied to the stages after the eighth stage ST8 in the same manner.

The first clock signal CK1 has a rising edge corresponding to a first time t1. The second clock signal CK2 has a rising edge corresponding to a second time t2 later than the first time t1. The third clock signal CK3 has a rising edge corresponding to a third time t3 later than the second time t2. The fourth clock signal CK4 has a rising edge corresponding to a fourth time t4 later than the third time t3.

In an exemplary embodiment, the third clock signal CK3 may have the rising edge corresponding to a midpoint of adjacent rising edges of the first clock signal CK1, for example. In an exemplary embodiment, the fourth clock signal CK4 may have the rising edge corresponding to a midpoint of adjacent rising edges of the second clock signal CK2, for example.

In an exemplary embodiment, duty ratios of the first to fourth clock signals CK1, CK2, CK3 and CK4 may be about 50 percent (%), for example. The third clock signal CK3 may be an inverted signal of the first clock signal CK1. In addition, the fourth clock signal CK4 may be an inverted signal of the second clock signal CK2.

In an exemplary embodiment, the duty ratios of the first to fourth clock signals CK1, CK2, CK3 and CK4 may be greater or less than about 50%, for example. When the duty ratios of the first to fourth clock signals CK1, CK2, CK3 and CK4 may be greater or less than about 50%, the third clock signal CK3 may have the rising edge corresponding to a midpoint of adjacent rising edges of the first clock signal CK1 but the third clock signal CK3 may not be an inverted signal of the first clock signal CK1.

Although the four clock signals having different timings are applied to the stages in the exemplary embodiment for convenience of explanation, the invention is not limited thereto. In an alternative exemplary embodiment, eight clock signals having different timings are applied to the stages. In an alternative exemplary embodiment, six clock signals having different timings are applied to the stages.

Figure 4:
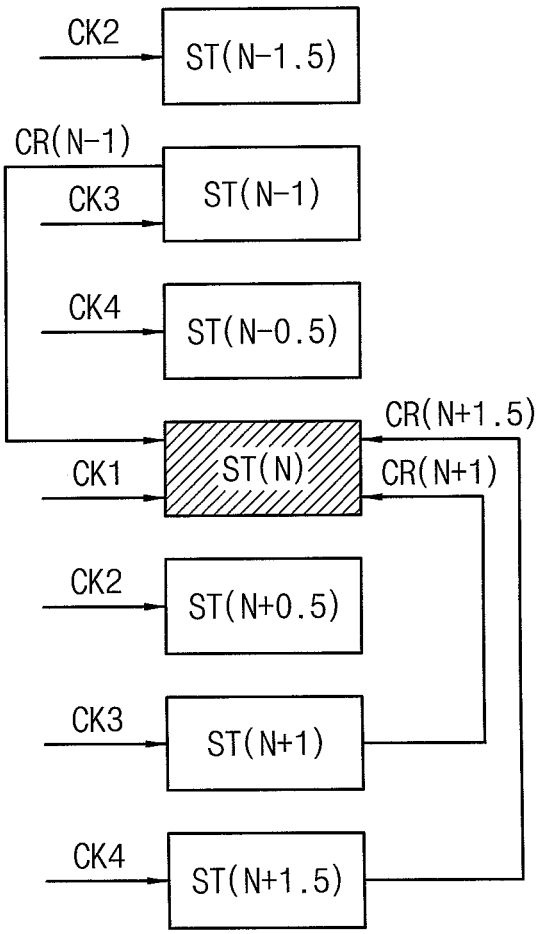
FIG. 4 is a block diagram illustrating clock signals and carry signals applied to an N-th stage of FIG. 1.

FIG. 4 is a block diagram illustrating clock signals and carry signals applied to an N-th stage ST(N) of the gate driver 300 of FIG. 1.

Referring to FIGS. 1 to 4, the N-th stage ST(N) of the gate driver 300 may receive the first clock signal CK1. The N-th stage ST(N) of the gate driver 300 may receive a previous carry signal CR(N−1), a first next carry signal CR(N+1.5) and a second next carry signal CR(N+1). Herein, N is a positive integer.

In an exemplary embodiment, the previous carry signal CR(N−1) may be a carry signal of a second previous stage ST(N−1) disposed at a second previous stage position from the present stage ST(N), for example. The second previous stage ST(N−1) may receive the third clock signal CK3. The third clock signal CK3 may be the inverted signal of the first clock signal CK1.

In an exemplary embodiment, the first next carry signal CR(N+1.5) may be a carry signal of a third next stage ST(N+1.5) disposed at a third next stage position from the present stage ST(N), for example. The third next stage ST(N+1.5) may receive the fourth clock signal CK4.

In an exemplary embodiment, the second next carry signal CR(N+1) may be a carry signal of a second next stage ST(N+1) disposed at a second next stage position from the present stage ST(N), for example. The second next stage ST(N+1) may receive the third clock signal CK3. The third clock signal CK3 may be the inverted signal of the first clock signal CK1.

Although the four clock signals having different timings are applied to the stages in the illustrated exemplary embodiment for convenience of explanation, the invention is not limited thereto. In an alternative exemplary embodiment, eight clock signals having different timings are applied to the stages. The eighth clock signals may have rising edges having uniform gaps between one another.

In the exemplary embodiment when the eighth clock signals having different timings are applied to the stages, the N-th stage ST(N) of the gate driver 300 may receive the first clock signal CK1. The N-th stage ST(N) of the gate driver 300 may receive a previous carry signal CR(N−1), a first next carry signal CR(N+1.5) and a second next carry signal CR(N+1).

In the exemplary embodiment when the eighth clock signals having different timings are applied to the stages, the previous carry signal CR(N−1) may be a carry signal of a fourth previous stage ST(N−1) disposed at a fourth previous stage position from the present stage ST(N). The fourth previous stage ST(N−1) may receive a fifth clock signal CK5. The fifth clock signal CK5 may be the inverted signal of the first clock signal CK1.

In the exemplary embodiment, the first next carry signal CR(N+1.5) may be a carry signal of a sixth next stage ST(N+1.5) disposed at a sixth next stage position from the present stage ST(N), for example. The sixth next stage ST(N+1.5) may receive a seventh clock signal CK7.

In the exemplary embodiment, the second next carry signal CR(N+1) may be a carry signal of a fourth next stage ST(N+1) disposed at a fourth next stage position from the present stage ST(N), for example. The fourth next stage ST(N+1) may receive the fifth clock signal CK5. The fifth clock signal CK5 may be the inverted signal of the first clock signal CK1.

Figure 5:
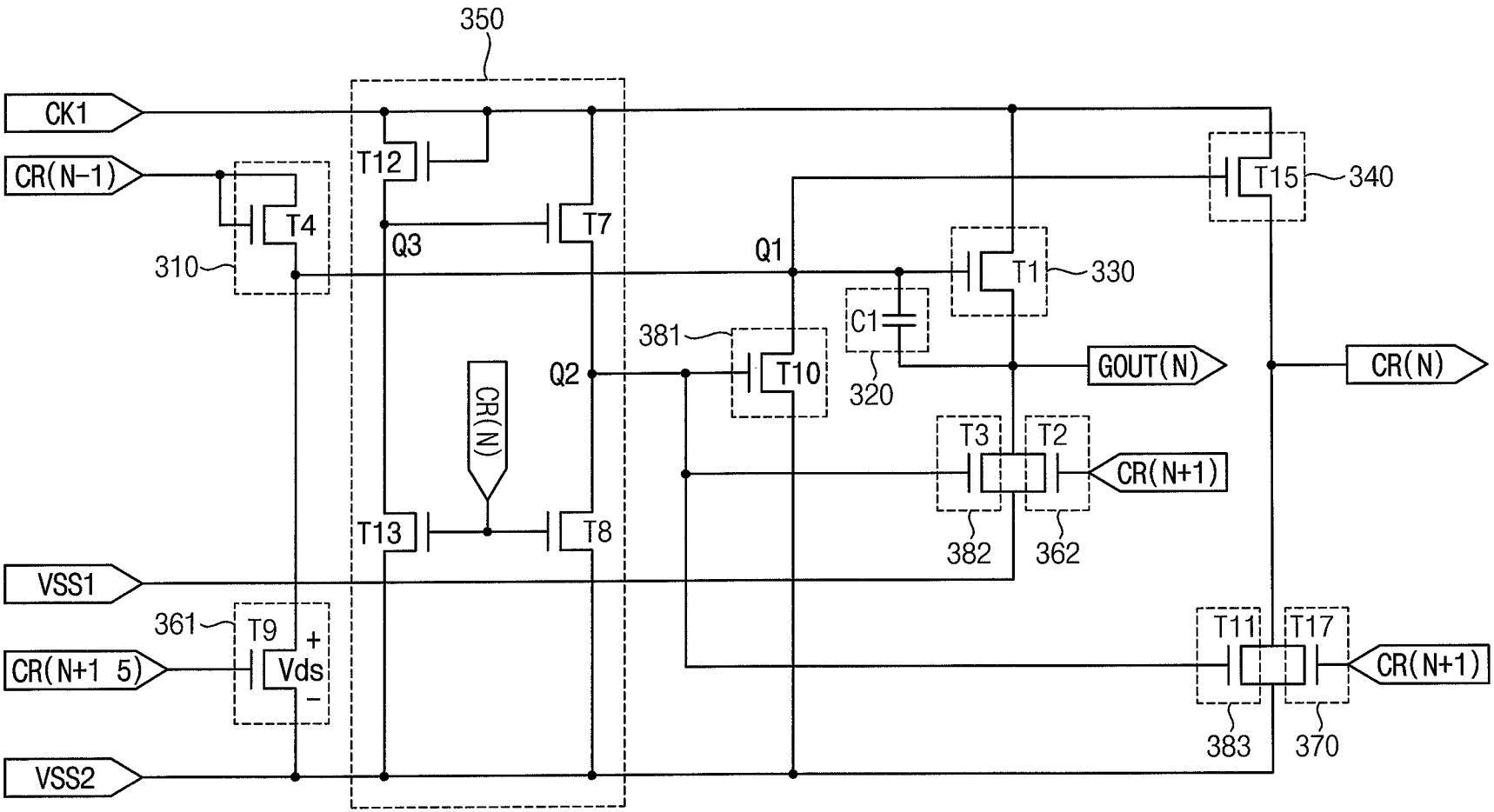
FIG. 5 is an equivalent circuit diagram illustrating the N-th stage of the gate driver of FIG. 1.
Figure 6:
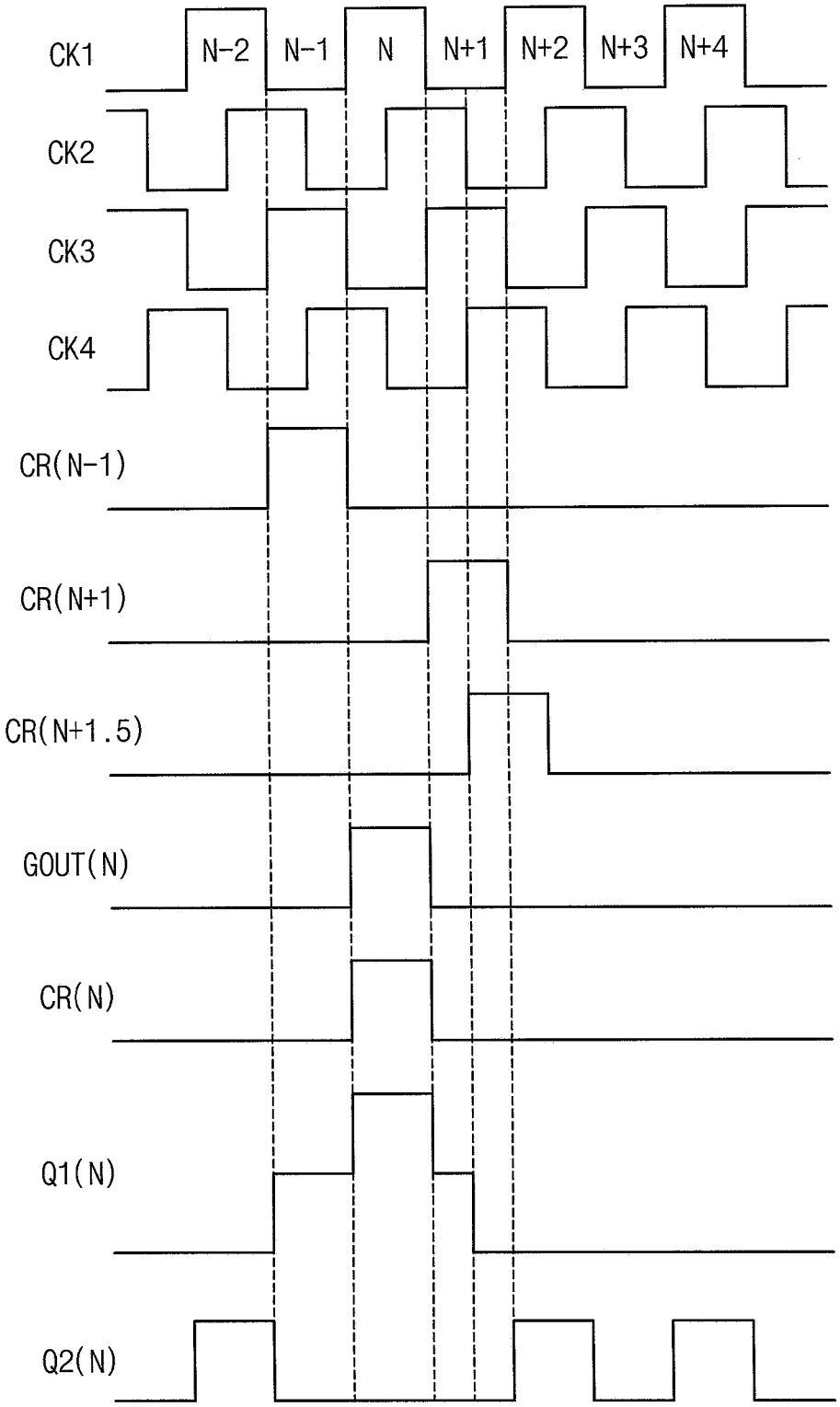
FIG. 6 is a waveform diagram illustrating input signals, node signals and output signals of the N-th stage of the gate driver of FIG. 5.

FIG. 5 is an equivalent circuit diagram illustrating the N-th stage ST(N) of the gate driver of FIG. 1. FIG. 6 is a waveform diagram illustrating input signals, node signals and output signals of the N-th stage ST(N) of the gate driver of FIG. 5.

Referring to FIGS. 1 to 6, the gate driver 300 receives first to fourth clock signals CK1, CK2, CK3 and CK4, a first off voltage VSS1 and a second off voltage VSS2. The gate driver 300 outputs a gate output signal GOUT.

The first to fourth clock signals CK1, CK2, CK3 and CK4 are applied to a clock terminal. The first off voltage VSS1 is applied to a first off terminal. The second off voltage VSS2 is applied to a second off terminal. The gate output signal GOUT is outputted from a gate output terminal.

The clock signal CK1 to CK4 is a square wave having a high level and a low level alternated with each other. The high level of the clock signal CK1 to CK4 may correspond to a gate on voltage. The low level of the clock signal CK1 to CK4 may correspond to the second gate off voltage VSS2. In an exemplary embodiment, a duty ratio of the clock signal CK1 to CK4 may be about 50%, for example. In an alternative exemplary embodiment, the duty ratio of the clock signal CK1 to CK4 may be greater than or less than about 50%. In an exemplary embodiment, the gate on voltage may be between about 15 volts (V) and about 20V, for example.

The first off voltage VSS1 may be a direct-current ("DC") signal. The second off voltage may be a DC signal. The second off voltage may have a level lower than a level of the first off voltage VSS1. In an exemplary embodiment, the first off voltage VSS1 may be about −5V, for example. In an exemplary embodiment, the second off voltage VSS2 may be about −10V, for example.

The N-th stage ST(N) outputs an N-th gate output signal GOUT(N) and an N-th carry signal CR(N) in response to a carry signal (e.g. CR(N−1)) of one of previous stages of the N-th stage ST(N). The N-th stage ST(N) pulls down the N-th gate output signal GOUT(N) to the first off voltage VSS1 in response to a carry signal (e.g. CR(N+1)) of one of next stages of the N-th stage ST(N).

In a similar manner, first to last stages sequentially outputs gate output signals GOUT.

The (N−1)-th carry signal CR(N−1) is applied to an (N−1)-th carry terminal. The (N+1)-th carry signal CR(N+1) is applied to an (N+1)-th carry terminal. The (N+1.5)-th carry signal CR(N+1.5) is applied to an (N+1.5)-th carry terminal. The N-th carry signal CR(N) is outputted from an N-th carry terminal. The (N−1)-th carry signal may be a carry signal of the second previous stage ST(N−1) disposed at a second previous stage position from the present stage ST(N) of FIG. 4. The (N+1)-th carry signal may be a carry signal of the second next stage ST(N+1) disposed at a second next stage position from the present stage ST(N) of FIG. 4. The (N+1.5)-th carry signal may be a carry signal of the third next stage ST(N+1.5) disposed at a third next stage position from the present stage ST(N) of FIG. 4.

The n-th stage ST(N) includes a pull-up control part 310, a charging part 320, a pull-up part 330, a carry part 340, an inverting part 350, a first pull-down part 361, a second pull-down part 362, a carry pull-down part 370, a first holding part 381, a second holding part 382 and a third holding part 383.

The pull-up control part 310 includes a fourth transistor T4. The fourth transistor T4 includes a control electrode and an input electrode commonly connected to the (N−1)-th carry terminal, and an output electrode connected to a first node Q1. The first node Q1 is connected to a control electrode of the pull-up part 330.

The charging part 320 includes a charging capacitor C1. The charging capacitor C1 includes a first electrode connected to the first node Q1 and a second electrode connected to the gate output terminal.

The pull-up part 330 outputs the first clock signal CK1 as the N-th gate output signal GOUT(N) in response to a signal applied to the first node Q1.

The pull-up part 330 includes a first transistor T1. The first transistor T1 includes a control electrode connected to the first node Q1, an input electrode connected to the clock terminal and an output electrode connected to the gate output terminal.

In an exemplary embodiment, the control electrode of the first transistor T1 may be a gate electrode, for example. In an exemplary embodiment, the input electrode of the first transistor T1 may be a source electrode, for example. In an exemplary embodiment, the output electrode of the first transistor T1 may be a drain electrode, for example.

The carry part 340 outputs the first clock signal CK1 as the N-th carry signal CR(N) in response to the signal applied to the first node Q1.

The carry part 340 includes a fifteenth transistor T15. The fifteenth transistor T15 includes a control electrode connected to the first node Q1, an input electrode connected to the clock terminal and an output electrode connected to the N-th carry terminal.

In an exemplary embodiment, the control electrode of the fifteenth transistor T15 may be a gate electrode, for example. In an exemplary embodiment, the input electrode of the fifteenth transistor T15 may be a source electrode, for example. In an exemplary embodiment, the output electrode of the fifteenth transistor T15 may be a drain electrode, for example.

The inverting part 350 generates an inverting signal based on the first clock signal CK1 and the second off voltage VSS2 to output the inverting signal to a second node Q2. The second node Q2 is also referred to as an inverting node.

The inverting part 350 includes a twelfth transistor T12, a thirteenth transistor T13, a seventh transistor T7 and an eighth transistor T8. The twelfth transistor T12 and the thirteenth transistor T13 are connected to each other in series. The seventh transistor T7 and the eighth transistor T8 are connected to each other in series.

The twelfth transistor T12 includes a control electrode and an input electrode commonly connected to the clock terminal, and an output electrode connected to a third node Q3. The seventh transistor T7 includes a control electrode connected to the third node Q3, an input electrode connected to the clock terminal and an output electrode connected to the second node Q2. The thirteenth transistor T13 includes a control electrode connected to the N-th carry terminal, an input electrode connected to the second off terminal and an output electrode connected to the third node Q3. The eighth transistor T8 includes a control electrode connected to the N-th carry terminal, an input electrode connected to the second off terminal and an output electrode connected to the second node Q2.

In an exemplary embodiment, the control electrodes of the twelfth, seventh, thirteenth and eighth transistors T12, T7, T13 and T8 may be gate electrodes, for example. In an exemplary embodiment, the input electrode of the twelfth, seventh, thirteenth and eighth transistors T12, T7, T13 and T8 may be source electrodes, for example. In an exemplary embodiment, the output electrode of the twelfth, seventh, thirteenth and eighth transistors T12, T7, T13 and T8 may be drain electrodes, for example.

Herein, the twelfth transistor T12 is a first inverting transistor. The seventh transistor T7 is a second inverting transistor. The thirteenth transistor T13 is a third inverting transistor. The eighth transistor T8 is a fourth inverting transistor.

The first pull-down part 361 pulls down the voltage at the first node Q1 to the second off voltage VSS2 in response to the (N+1.5)-th carry signal CR(N+1.5).

The first pull-down part 361 includes a ninth transistor T9. The ninth transistor T9 includes a control electrode connected to the (N+1.5)-th carry terminal, an input electrode connected to the second off terminal and an output electrode connected to the first node Q1.

In an alternative exemplary embodiment, the first pull-down part 361 may include two transistors connected to each other in series. However, the invention is not limited thereto, and the first pull-down part 361 may include more than two transistors connected to one another in series.

In an exemplary embodiment, the control electrode of the ninth transistor T9 may be a gate electrode, for example. In an exemplary embodiment, the input electrode of the ninth transistor T9 may be a source electrode, for example. In an exemplary embodiment, the output electrode of the ninth transistor T9 may be a drain electrode, for example.

The second pull-down part 362 pulls down the N-th gate output signal GOUT(N) to the first off voltage VSS1 in response to the (N+1)-th carry signal CR(N+1).

The second pull-down part 362 includes the second transistor T2. The second transistor T2 includes a control electrode connected to the (N+1)-th carry terminal, an input electrode connected to the first off terminal and an output electrode connected to the gate output terminal.

In an exemplary embodiment, the control electrode of the second transistor T2 may be a gate electrode, for example. In an exemplary embodiment, the input electrode of the second transistor T2 may be a source electrode, for example. In an exemplary embodiment, the output electrode of the second transistor T2 may be a drain electrode, for example.

The carry pull-down part 370 pulls down the N-th carry signal CR(N) to the second off voltage VSS2 in response to the (N+1)-th carry signal CR(N+1).

The carry pull-down part 370 includes a seventeenth transistor T17. The seventeenth transistor T17 includes a control electrode connected to the (N+1)-th carry terminal, an input electrode connected to the second off terminal and an output electrode connected to the N-th carry terminal.

In an exemplary embodiment, the control electrode of the seventeenth transistor T17 may be a gate electrode, for example. In an exemplary embodiment, the input electrode of the seventeenth transistor T17 may be a source electrode, for example. In an exemplary embodiment, the output electrode of the seventeenth transistor T17 may be a drain electrode, for example.

The first holding part 381 pulls down the voltage at the first node Q1 to the second off voltage VSS2 in response to the inverting signal applied to the second node Q2.

The first holding part 381 includes a tenth transistor T10. The tenth transistor T10 includes a control electrode connected to the second node Q2, an input electrode connected to the second off terminal and an output electrode connected to the first node Q1.

In an alternative exemplary embodiment, the first holding part 381 may include two transistors connected to each other in series. However, the invention is not limited thereto, and the first holding part 381 may include more than two transistors connected to one another in series.

In an exemplary embodiment, the control electrode of the tenth transistor T10 may be a gate electrode, for example. In an exemplary embodiment, the input electrode of the tenth transistor T10 may be a source electrode, for example. In an exemplary embodiment, the output electrode of the tenth transistor T10 may be a drain electrode, for example.

The second holding part 382 pulls down the N-th gate output signal GOUT(N) to the first off voltage VSS1 in response to the inverting signal applied to the second node Q2.

The second holding part 382 includes a third transistor T3. The third transistor T3 includes a control electrode connected to the second node Q2, an input electrode connected to the first off terminal and an output electrode connected to the gate output terminal.

In an exemplary embodiment, the control electrode of the third transistor T3 may be a gate electrode, for example. In an exemplary embodiment, the input electrode of the third transistor T3 may be a source electrode, for example. In an exemplary embodiment, the output electrode of the third transistor T3 may be a drain electrode, for example.

The third holding part 383 pulls down the N-th carry signal CR(N) to the second off voltage VSS2 in response to the inverting signal applied to the second node Q2.

The third holding part 383 includes an eleventh transistor T11. The eleventh transistor T11 includes a control electrode connected to the second node Q2, an input electrode connected to the second off terminal and an output electrode connected to the N-th carry terminal.

In an exemplary embodiment, the control electrode of the eleventh transistor T11 may be a gate electrode, for example. In an exemplary embodiment, the input electrode of the eleventh transistor T11 may be a source electrode, for example. In an exemplary embodiment, the output electrode of the eleventh transistor T11 may be a drain electrode, for example.

In the illustrated exemplary embodiment, the first, second, third, fourth, seventh, eighth, ninth, tenth, eleventh, twelfth, thirteenth, fifteenth and seventeenth transistors T1, T2, T3, T4, T7, T8, T9, T10, T11, T12, T13, T15 and T17 may be oxide semiconductor transistors, for example. A semiconductor layer of the oxide semiconductor transistor may include an oxide semiconductor. In an exemplary embodiment, the semiconductor layer may include at least one of a zinc oxide, a tin oxide, a gallium indium zinc (Ga—In—Zn) oxide, an indium zinc (In—Zn) oxide, a indium tin (In—Sn) oxide, indium tin zinc (In—Sn—Zn) oxide and so on, for example. In an exemplary embodiment, the semiconductor layer 130 may include an oxide semiconductor doped with a metal such as aluminum (Al), nickel (Ni), copper (Cu), tantalum (Ta), molybdenum (Mo), hafnium (Hf), titanium (Ti), niobium (Nb), chromium Cr, tungsten (W). However, the invention is not limited to a material of the oxide semiconductor.

In an alternative exemplary embodiment, the first, second, third, fourth, seventh, eighth, ninth, tenth, eleventh, twelfth, thirteenth, fifteenth and seventeenth transistors T1, T2, T3, T4, T7, T8, T9, T10, T11, T12, T13, T15 and T17 may be amorphous silicon transistors, for example. However, the invention is not limited thereto, and the first, second, third, fourth, seventh, eighth, ninth, tenth, eleventh, twelfth, thirteenth, fifteenth and seventeenth transistors T1, T2, T3, T4, T7, T8, T9, T10, T11, T12, T13, T15 and T17 may include various other types of transistors.

Referring to FIG. 6, the first clock signal CK1 has a high level corresponding to (N−2)-th stage, N-th stage, (N+2)-th stage and (N+4)-th stage. The third clock signal CK3 which is the inverting signal of the first clock signal CK1 has a high level corresponding to (N−1)-th stage, (N+1)-th stage and (N+3)-th stage.

The (N−1)-th carry signal CR(N−1) has a high level corresponding to the (N−1)-th stage. The (N+1)-th carry signal CR(N+1) has a high level corresponding to the (N+1)-th stage. The (N+1.5)-th carry signal CR(N+1.5) has a high level corresponding to a second half of the (N+1)-th stage and a first half of the (N+2)-th stage.

The gate output signal GOUT(N) of the N-th stage is synchronized with the first clock signal CK1, and has a high level corresponding to the N-th stage. The N-th carry signal CR(N) is synchronized with the first clock signal CK1, and has a high level corresponding to the N-th stage.

A voltage Q1(N) of the first node Q1 of the N-th stage is increased to a first level corresponding to the (N−1)-th stage by the pull-up control part 310. The voltage Q1(N) at the first node Q1 of the N-th stage is increased to a second level, which is higher than the first level, corresponding to the N-th stage by the coupling generated at the pull-up part 330 and the charging part 320. In addition, the voltage Q1(N) at the first node Q1 of the N-th stage is decreased to a third level, which is lower than the second level, corresponding to a beginning of the (N+1)-th stage by the coupling generated at the charging part 320. In addition, the voltage Q1(N) at the first node Q1 of the N-th stage is decreased to the lowest level, corresponding to a beginning of the second half of the (N+1)-th stage by the first pull-down part 361. In an exemplary embodiment, the third level may be substantially the same as the first level, for example.

A voltage Q2(N) at the second node Q2 of the N-th stage is synchronized with the first clock signal CK1. The voltage Q2(N) of the second node Q2 of the N-th stage has a high level corresponding to the (N−2)-th stage, (N+2)-th stage and the (N+4)-th stage by the inverting part 350. The voltage Q2(N) of the second node Q2 of the N-th stage has a high level except for the N-th stage at which the gate output signal GOUT has a high level. The voltage of the second node Q2 may be an inverting signal.

According to the illustrated exemplary embodiment, the voltage at the first node Q1 is not decreased from the second level to the lowest level at once but gradually decreased by the charging part 320 and the first pull-down part 361. Thus, the drain-source voltage Vds (refer to FIG. 5) of the ninth transistor T9 (refer to FIG. 5) is decreased so that the redundant gate signal output and the line defect due to the abnormal operation of the ninth transistor T9 may be prevented. Therefore, the reliability of the gate driving circuit may be improved. In addition, the display quality of the display panel 100 (refer to FIG. 1) may be improved.

Figure 7:
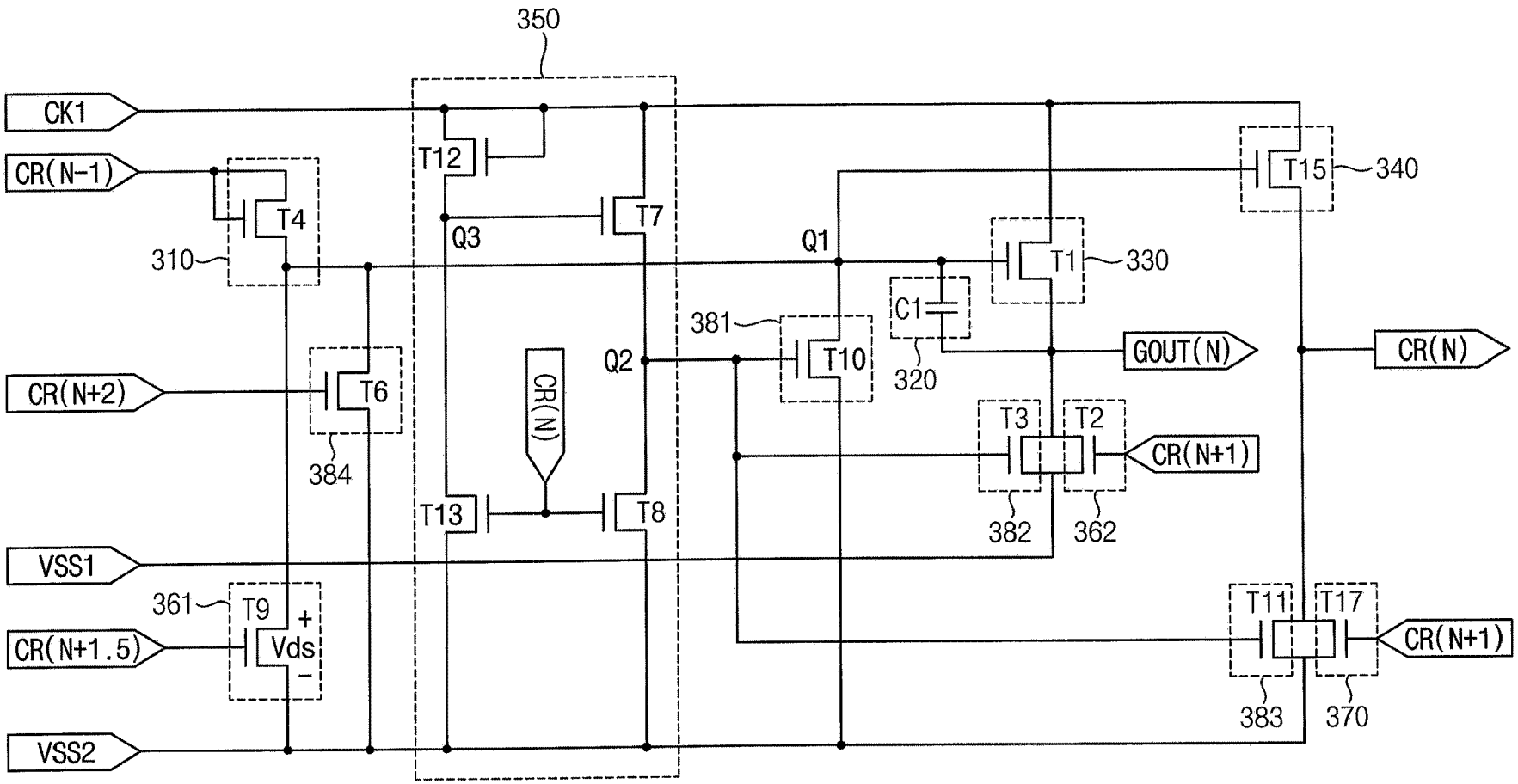
FIG. 7 is an equivalent circuit diagram illustrating an exemplary embodiment of an N-th stage of a gate driver of a display apparatus according to the invention.

FIG. 7 is an equivalent circuit diagram illustrating an N-th stage ST(N) of a gate driver 300 of a display apparatus according to an exemplary embodiment of the invention.

The gate driving circuit according to the illustrated exemplary embodiment is substantially the same as the gate driving circuit of the previous exemplary embodiment described referring to FIGS. 1 to 6 except that the gate driving circuit further includes a fourth holding part. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 4, 6 and 7, the display apparatus includes a display panel 100 and a display panel driver. The display panel driver includes a timing controller 200, a gate driver 300, a gamma reference voltage generator 400 and a data driver 500.

The gate driver 300 includes a plurality of stages. In an exemplary embodiment, clock signals (e.g. CK1, CK2, CK3 and CK4) having four different timings may be applied to the stages of the gate driver 300, for example.

The gate driver 300 receives first to fourth clock signals CK1, CK2, CK3 and CK4, a first off voltage VSS1 and a second off voltage VSS2. The gate driver 300 outputs a gate output signal GOUT.

An N-th stage ST(N) of the gate driver 300 may receive the first clock signal CK1. The N-th stage ST(N) of the gate driver 300 may receive a previous carry signal CR(N−1), a first next carry signal CR(N+1.5), a second next carry signal CR(N+1) and a third next carry signal CR(N+2).

The (N−1)-th carry signal CR(N−1) is applied to an (N−1)-th carry terminal. The (N+1)-th carry signal CR(N+1) is applied to an (N+1)-th carry terminal. The (N+1.5)-th carry signal CR(N+1.5) is applied to an (N+1.5)-th carry terminal. The (N+2)-th carry signal CR(N+2) is applied to an (N+2)-th carry terminal. The N-th carry signal CR(N) is outputted from an N-th carry terminal. The (N−1)-th carry signal may be a carry signal of the second previous stage ST(N−1) disposed at a second previous stage position from the present stage ST(N) of FIG. 4. The (N+1)-th carry signal may be a carry signal of the second next stage ST(N+1) disposed at a second next stage position from the present stage ST(N) of FIG. 4. The (N+1.5)-th carry signal may be a carry signal of the third next stage ST(N+1.5) disposed at a third next stage position from the present stage ST(N) of FIG. 4. The (N+2)-th carry signal may be a carry signal of a fourth next stage ST(N+2) disposed at a fourth next stage position from the present stage ST(N).

The n-th stage ST(N) includes a pull-up control part 310, a charging part 320, a pull-up part 330, a carry part 340, an inverting part 350, a first pull-down part 361, a second pull-down part 362, a carry pull-down part 370, a first holding part 381, a second holding part 382, a third holding part 383 and a fourth holding part 384.

The first pull-down part 361 pulls down the voltage at the first node Q1 to the second off voltage VSS2 in response to the (N+1.5)-th carry signal CR(N+1.5).

The first pull-down part 361 includes a ninth transistor T9. The ninth transistor T9 includes a control electrode connected to the (N+1.5)-th carry terminal, an input electrode connected to the second off terminal and an output electrode connected to the first node Q1.

In an alternative exemplary embodiment, the first pull-down part 361 may include two transistors connected to each other in series. However, the invention is not limited thereto, and the first pull-down part 361 may include more than two transistors connected to one another in series.

The fourth holding part 384 pulls down the voltage at the first node Q1 to the second off voltage VSS2 in response to the (N+2)-th carry signal CR(N+2).

The fourth holding part 384 includes a sixth transistor T6. The sixth transistor T6 includes a control electrode connected to the (N+2)-th carry terminal, an input electrode connected to the second off terminal and an output electrode connected to the first node Q1.

In an exemplary embodiment, the control electrode of the sixth transistor T6 may be a gate electrode, for example. In an exemplary embodiment, the input electrode of the sixth transistor T6 may be a source electrode, for example. In an exemplary embodiment, the output electrode of the sixth transistor T6 may be a drain electrode, for example.

According to the illustrated exemplary embodiment, the voltage at the first node Q1 is not decreased from the second level to the lowest level at once but gradually decreased by the charging part 320 and the first pull-down part 361. Thus, the drain-source voltage Vds of the ninth transistor T9 is decreased so that the redundant gate signal output and the line defect due to the abnormal operation of the ninth transistor T9 may be prevented.

In addition, the voltage at the first node Q1 maintains the second off voltage VSS2 more stably by the fourth holding part 384. Therefore, the reliability of the gate driving circuit may be improved. In addition, the display quality of the display panel 100 may be improved.

Figure 8:
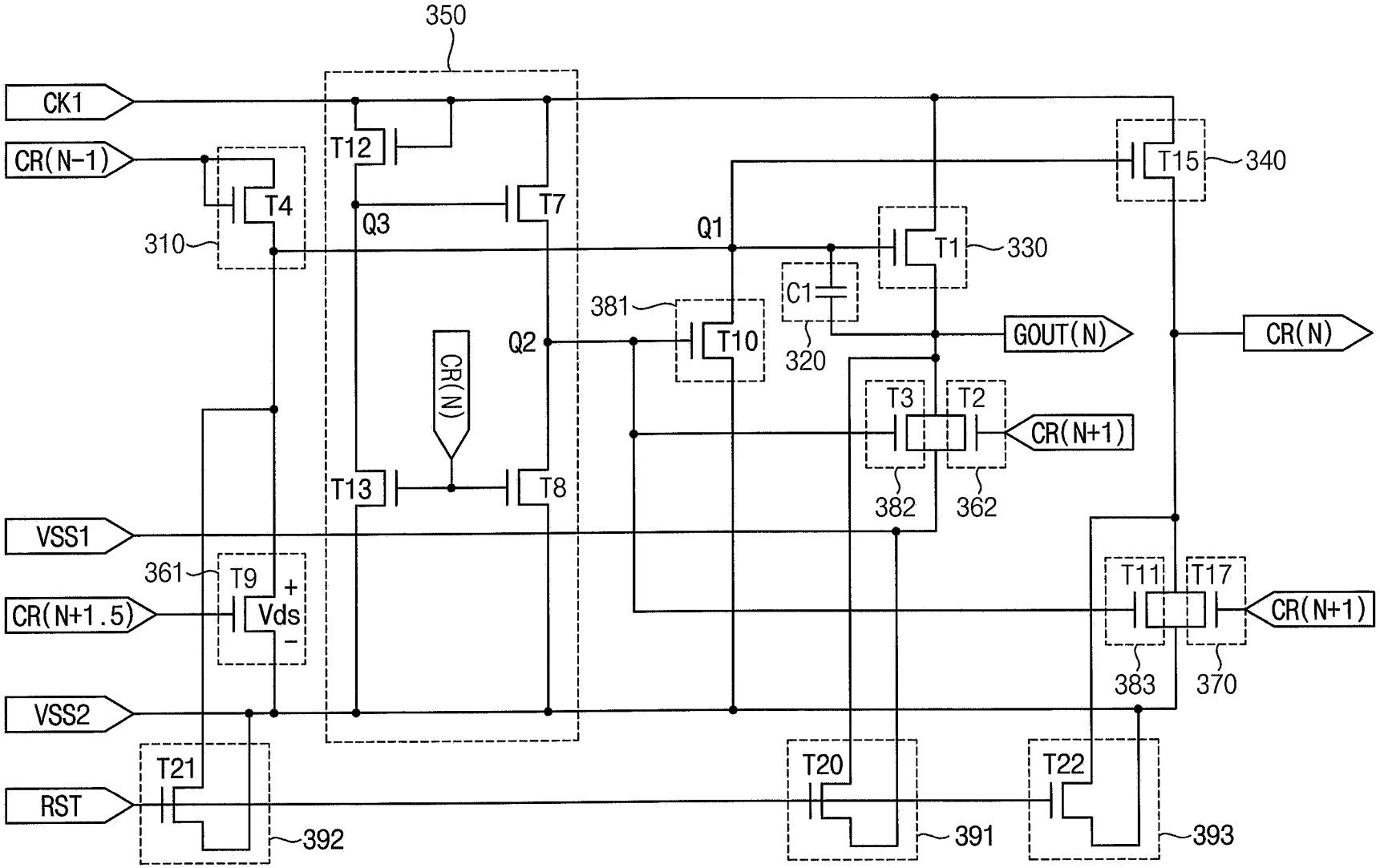
FIG. 8 is an equivalent circuit diagram illustrating an exemplary embodiment of an N-th stage of a gate driver of a display apparatus according to the invention.

FIG. 8 is an equivalent circuit diagram illustrating an N-th stage ST(N) of a gate driver 300 of a display apparatus according to an exemplary embodiment of the invention.

The gate driving circuit according to the illustrated exemplary embodiment is substantially the same as the gate driving circuit of the previous exemplary embodiment described referring to FIGS. 1 to 6 except that the gate driving circuit further includes first to third reset parts. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 4, 6 and 8, the display apparatus includes a display panel 100 and a display panel driver. The display panel driver includes a timing controller 200, a gate driver 300, a gamma reference voltage generator 400 and a data driver 500.

The gate driver 300 includes a plurality of stages. In an exemplary embodiment, clock signals (e.g. CK1, CK2, CK3 and CK4) having four different timings may be applied to the stages of the gate driver 300, for example.

The gate driver 300 receives first to fourth clock signals CK1, CK2, CK3 and CK4, a first off voltage VSS1, a second off voltage VSS2 and a reset signal RST. The gate driver 300 outputs a gate output signal GOUT.

An N-th stage ST(N) of the gate driver 300 may receive the first clock signal CK1. The N-th stage ST(N) of the gate driver 300 may receive a previous carry signal CR(N−1), a first next carry signal CR(N+1.5) and a second next carry signal CR(N+1).

The (N−1)-th carry signal CR(N−1) is applied to an (N−1)-th carry terminal. The (N+1)-th carry signal CR(N+1) is applied to an (N+1)-th carry terminal. The (N+1.5)-th carry signal CR(N+1.5) is applied to an (N+1.5)-th carry terminal. The (N+2)-th carry signal CR(N+2) is applied to an (N+2)-th carry terminal. The N-th carry signal CR(N) is outputted from an N-th carry terminal. The (N−1)-th carry signal may be a carry signal of the second previous stage ST(N−1) disposed at a second previous stage position from the present stage ST(N) of FIG. 4. The (N+1)-th carry signal may be a carry signal of the second next stage ST(N+1) disposed at a second next stage position from the present stage ST(N) of FIG. 4. The (N+1.5)-th carry signal may be a carry signal of the third next stage ST(N+1.5) disposed at a third next stage position from the present stage ST(N) of FIG. 4. The reset signal RST is applied to a reset terminal.

The n-th stage ST(N) includes a pull-up control part 310, a charging part 320, a pull-up part 330, a carry part 340, an inverting part 350, a first pull-down part 361, a second pull-down part 362, a carry pull-down part 370, a first holding part 381, a second holding part 382, a third holding part 383, a first reset part 391, a second reset part 392 and a third reset part 393.

The first pull-down part 361 pulls down the voltage at the first node Q1 to the second off voltage VSS2 in response to the (N+1.5)-th carry signal CR(N+1.5).

The first pull-down part 361 includes a ninth transistor T9. The ninth transistor T9 includes a control electrode connected to the (N+1.5)-th carry terminal, an input electrode connected to the second off terminal and an output electrode connected to the first node Q1.

In an alternative exemplary embodiment, the first pull-down part 361 may include two transistors connected to each other in series. However, the invention is not limited thereto, and the first pull-down part 361 may include more than two transistors connected to one another in series.

The first reset part 391 pulls down the N-th gate output signal GOUT(N) to the first off voltage VSS1 in response to the reset signal RST.

The first reset part 391 includes a twentieth transistor T20. The twentieth transistor T20 includes a control electrode connected to the reset terminal, an input electrode connected to the first off terminal and an output electrode connected to the gate output terminal.

The second reset part 392 pulls down the voltage at the first node Q1 to the second off voltage VSS2 in response to the reset signal RST.

The second reset part 392 includes a twenty-first transistor T21. The twenty-first transistor T21 includes a control electrode connected to the reset terminal, an input electrode connected to the second off terminal and an output electrode connected to the first node Q1.

The third reset part 393 pulls down the voltage at the N-th carry signal CR(N) to the second off voltage VSS2 in response to the reset signal RST.

The third reset part 393 includes a twenty-second transistor T22. The twenty-second transistor T22 includes a control electrode connected to the reset terminal, an input electrode connected to the second off terminal and an output electrode connected to the N-th carry terminal.

According to the illustrated exemplary embodiment, the voltage at the first node Q1 is not decreased from the second level to the lowest level at once but gradually decreased by the charging part 320 and the first pull-down part 361. Thus, the drain-source voltage Vds of the ninth transistor T9 is decreased so that the redundant gate signal output and the line defect due to the abnormal operation of the ninth transistor T9 may be prevented. Therefore, the reliability of the gate driving circuit may be improved. In addition, the display quality of the display panel 100 may be improved.

Figure 9:
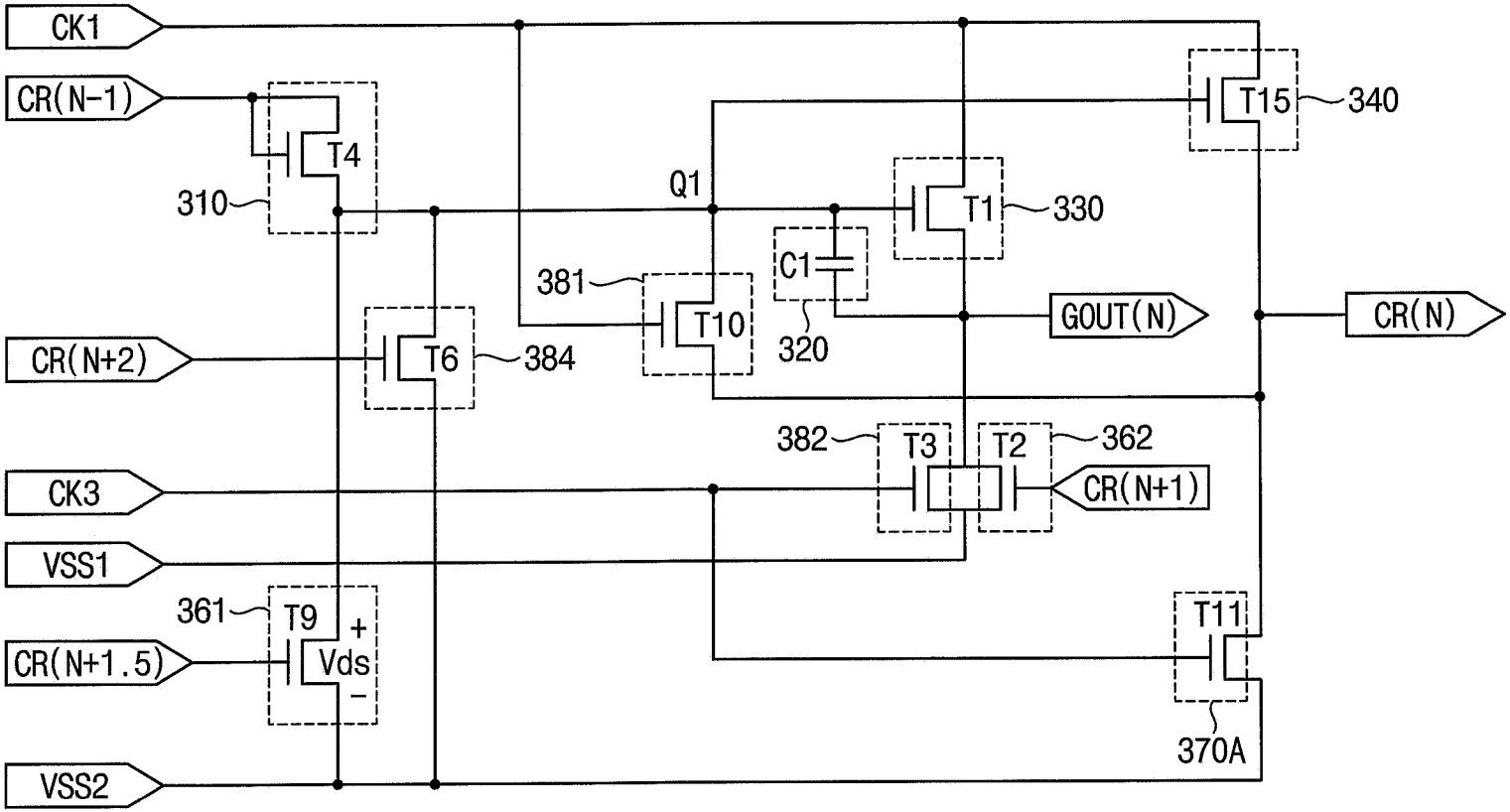
FIG. 9 is an equivalent circuit diagram illustrating an exemplary embodiment of an N-th stage of a gate driver of a display apparatus according to the invention.

FIG. 9 is an equivalent circuit diagram illustrating an N-th stage ST(N) of a gate driver 300 (refer to FIGS. 1 and 2) of a display apparatus according to an exemplary embodiment of the invention.

The gate driving circuit according to the illustrated exemplary embodiment is substantially the same as the gate driving circuit of the previous exemplary embodiment described referring to FIGS. 1 to 6 except that the gate driving circuit does not include an inverting part. Thus, the same reference numerals will be used to refer to the same or like parts as those described in the previous exemplary embodiment of FIGS. 1 to 6 and any repetitive explanation concerning the above elements will be omitted.

Referring to FIGS. 1 to 4, 6 and 9, the display apparatus includes a display panel 100 and a display panel driver. The display panel driver includes a timing controller 200, a gate driver 300, a gamma reference voltage generator 400 and a data driver 500.

The gate driver 300 includes a plurality of stages. In an exemplary embodiment, clock signals (e.g. CK1, CK2, CK3 and CK4) having four different timings may be applied to the stages of the gate driver 300, for example.

The gate driver 300 receives first to fourth clock signals CK1, CK2, CK3 and CK4, a first off voltage VSS1 and a second off voltage VSS2. The gate driver 300 outputs a gate output signal GOUT.

An N-th stage ST(N) of the gate driver 300 may receive the first clock signal CK1 and the third clock signal CK3. In the illustrated exemplary embodiment, the third clock signal CK3 may be an inverting signal of the first clock signal CK1. The N-th stage ST(N) of the gate driver 300 may receive a previous carry signal CR(N−1), a first next carry signal CR(N+1.5), a second next carry signal CR(N+1) and a third next carry signal CR(N+2).

The (N−1)-th carry signal CR(N−1) is applied to an (N−1)-th carry terminal. The (N+1)-th carry signal CR(N+1) is applied to an (N+1)-th carry terminal. The (N+1.5)-th carry signal CR(N+1.5) is applied to an (N+1.5)-th carry terminal. The (N+2)-th carry signal CR(N+2) is applied to an (N+2)-th carry terminal. The N-th carry signal CR(N) is outputted from an N-th carry terminal. The (N−1)-th carry signal may be a carry signal of the second previous stage ST(N−1) disposed at a second previous stage position from the present stage ST(N) of FIG. 4. The (N+1)-th carry signal may be a carry signal of the second next stage ST(N+1) disposed at a second next stage position from the present stage ST(N) of FIG. 4. The (N+1.5)-th carry signal may be a carry signal of the third next stage ST(N+1.5) disposed at a third next stage position from the present stage ST(N) of FIG. 4. The (N+2)-th carry signal may be a carry signal of a fourth next stage ST(N+2) disposed at a fourth next stage position from the present stage ST(N).

The n-th stage ST(N) includes a pull-up control part 310, a charging part 320, a pull-up part 330, a carry part 340, a first pull-down part 361, a second pull-down part 362, a carry pull-down part 370A, a first holding part 381, a second holding part 382 and fourth holding part 384.

The first pull-down part 361 pulls down the voltage at the first node Q1 to the second off voltage VSS2 in response to the (N+1.5)-th carry signal CR(N+1.5).

The first pull-down part 361 includes a ninth transistor T9. The ninth transistor T9 includes a control electrode connected to the (N+1.5)-th carry terminal, an input electrode connected to the second off terminal and an output electrode connected to the first node Q1.

In an alternative exemplary embodiment, the first pull-down part 361 may include two transistors connected to each other in series. However, the invention is not limited thereto, and the first pull-down part 361 may include more than two transistors connected to one another in series.

The carry pull-down part 370A pulls down the N-th carry signal CR(N) to the second off voltage VSS2 in response to the inverted clock signal CK3 of the first clock signal CK1.

The carry pull-down part 370A includes an eleventh transistor T11. The eleventh transistor T11 includes a control electrode to which the inverted clock signal CK3 is applied, an input electrode connected to the second off terminal and an output electrode connected to the N-th carry terminal.

The fourth holding part 384 pulls down the voltage at the first node Q1 to the second off voltage VSS2 in response to the (N+2)-th carry signal CR(N+2).

The fourth holding part 384 includes a sixth transistor T6. The sixth transistor T6 includes a control electrode connected to the (N+2)-th carry terminal, an input electrode connected to the second off terminal and an output electrode connected to the first node Q1.

The first holding part 381 applies the N-th carry signal to the first node Q1 in response to the first clock signal CK1.

The first holding part 381 includes a tenth transistor T10. The tenth transistor T10 includes a control electrode connected to a clock terminal, an input electrode connected to the N-th carry terminal and an output electrode connected to the first node Q1.

In an alternative exemplary embodiment, the first holding part 381 may include two transistors connected to each other in series. However, the invention is not limited thereto, and the first holding part 381 may include more than two transistors connected to one another in series.

The second holding part 382 pulls down the N-th gate output signal GOUT(N) to the first off voltage VSS1 in response to the inverted clock signal CK3.

The second holding part 382 includes a third transistor T3. The third transistor T3 includes a control electrode connected to the inverted clock terminal, an input electrode connected to the first off terminal and an output electrode connected to the gate output terminal.

According to the illustrated exemplary embodiment, the voltage at the first node Q1 is not decreased from the second level to the lowest level at once but gradually decreased by the charging part 320 and the first pull-down part 361. Thus, the drain-source voltage Vds of the ninth transistor T9 is decreased so that the redundant gate signal output and the line defect due to the abnormal operation of the ninth transistor T9 may be prevented. Therefore, the reliability of the gate driving circuit may be improved. In addition, the display quality of the display panel 100 may be improved.

According to the invention as described above, a reliability of the gate driving circuit may be improved and a display quality of the display panel may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A gate driving circuit comprising:

stages which respectively output carry signals and gate output signals, an N-th stage of the stages comprising:

a pull-up control part which applies a previous carry signal of the carry signals of one of previous stages of the stages to a first node in response to the previous carry signal;

a pull-up part which outputs a clock signal as an N-th gate output signal in response to a signal at the first node;

a carry part which is directly connected to an output node which outputs the clock signal as an N-th carry signal in response to the signal at the first node;

a first pull-down part which pulls down the signal at the first node to a second off voltage in response to a first next carry signal of one of next stages;

a second pull-down part which pulls down the N-th gate output signal to a first off voltage in response to a second next carry signal of one of the next stages different from the first next carry signal, and a carry pull down part which is directly connected to the output node and pulls down the N-th carry signal to the second off voltage in response to the second next carry signal, wherein N is a positive integer.

2. The gate driving circuit of claim 1, wherein the first next carry signal has a timing later than a timing of the second next carry signal.

3. The gate driving circuit of claim 2, wherein the gate driving circuit further comprises:

a first next stage disposed at a first next stage position from the N-th stage;

a second next stage disposed at a second next stage position from the N-th stage; and a third next stage position disposed at a third next stage position from the N-th stage, the first next carry signal is a carry signal of the third next stage, and the second next carry signal is a carry signal of the second next stage.

4. The gate driving circuit of claim 3, wherein a first clock signal is applied to the N-th stage, a second clock signal different from the first clock signal is applied to the first next stage, a third clock signal different from the first clock signal and the second clock signal is applied to the second next stage, and a fourth clock signal different from the first clock signal, the second clock signal and the third clock signal is applied to the third next stage.

5. The gate driving circuit of claim 4, wherein the third clock signal is an inverted signal of the first clock signal, and the fourth clock signal is an inverted signal of the second clock signal.

6. The gate driving circuit of claim 1, further comprising an inverting part which generates an inverting signal based on the clock signal and the second off voltage and output the inverting signal to an inverting node.

7. The gate driving circuit of claim 6, wherein the inverting part includes:

a first inverting transistor;

a second inverting transistor;

a third inverting transistor; and a fourth inverting transistor, the first inverting transistor and the third inverting transistor are connected to each other in series, the second inverting transistor and the fourth inverting transistor are connected to each other in series, the first inverting transistor includes a control electrode and an input electrode to which the clock signal is commonly applied and an output electrode connected to a third node, the second inverting transistor includes a control electrode connected to the third node, an input electrode to which the clock signal is applied and an output electrode connected to the inverting node, the third inverting transistor includes a control electrode connected to a carry terminal from which the N-th carry signal is outputted, an input electrode to which the second off voltage is applied and an output electrode connected to the third node, and the fourth inverting transistor includes a control electrode connected to the carry terminal, an input electrode to which the second off voltage is applied and the output electrode connected to the inverting node.

8. The gate driving circuit of claim 6, further comprising a first holding part which pulls down the signal at the first node to the second off voltage in response to the inverting signal at the inverting node.

9. The gate driving circuit of claim 8, further comprising a second holding part which pulls down the N-th gate output signal to the first off voltage in response to the inverting signal at the inverting node.

10. The gate driving circuit of claim 9, further comprising a third holding part which pulls down the N-th carry signal to the second off voltage in response to the inverting signal at the inverting node.

11. The gate driving circuit of claim 1, further comprising a fourth holding part which pulls down the signal at the first node to the second off voltage in response to a third next carry signal of one of the next stages different from the first next carry signal and the second next carry signal.

12. The gate driving circuit of claim 1, further comprising:

a first reset part which pulls down the N-th gate output signal to the first off voltage in response to a reset signal;

a second reset part which pulls down the signal at the first node to the second off voltage in response to the reset signal; and a third reset part which pulls down the N-th carry signal to the second off voltage in response to the reset signal.

13. The gate driving circuit of claim 1, further comprising a carry pull down part which pulls down the N-th carry signal to the second off voltage in response to an inverted clock signal different from the clock signal.

14. The gate driving circuit of claim 13, further comprising a fourth holding part which pulls down the signal at the first node to the second off voltage in response to a third next carry signal of one of the next stages different from the first next carry signal and the second next carry signal.

15. The gate driving circuit of claim 14, further comprising a first holding part which applies the N-th carry signal to the first node in response to the clock signal.

16. The gate driving circuit of claim 15, further comprising a second holding part which pulls down the N-th gate output part to the first off voltage in response to the inverted clock signal.

17. A display apparatus comprising:

a display panel which displays an image;

a data driving circuit which applies a data voltage to the display panel; and a gate driving circuit which applies a gate output signal to the display panel, the gate driving circuit comprising:

stages which respectively output carry signals and gate output signals, an N-th stage of the stages comprising:

a pull-up control part which applies a previous carry signal of one of previous stages to a first node in response to the previous carry signal;

a pull-up part which outputs a clock signal as an N-th gate output signal in response to a signal at the first node;

a carry part which is directly connected to an output node which outputs the clock signal as an N-th carry signal in response to the signal at the first node;

a first pull-down part which pulls down the signal at the first node to a second off voltage in response to a first next carry signal of one of next stages; and a second pull-down part which pulls down the N-th gate output signal to a first off voltage in response to a second next carry signal of one of the next stages different from the first next carry signal; and a carry pull down part which is directly connected to the output node and pulls down the N-th carry signal to the second off voltage in response to the second next carry signal, wherein N is a positive integer.

18. The display apparatus of claim 17, wherein the first next carry signal has a timing later than a timing of the second next carry signal.

19. The display apparatus of claim 18, wherein the display apparatus further comprises:

a first next stage disposed at a first next stage position from the N-th stage;

a second next stage disposed at a second next stage position from the N-th stage; and a third next stage position disposed at a third next stage position from the N-th stage, the first next carry signal is a carry signal of the third next stage, and the second next carry signal is a carry signal of the second next stage.

* * * * *